US007648842B2

(12) United States Patent
Hartlep

(10) Patent No.: US 7,648,842 B2
(45) Date of Patent: Jan. 19, 2010

(54) SECURITY PAPER AUTHENTICATION SYSTEM WITH DUAL INSTANT COLOR

(75) Inventor: Tianyan Xie Hartlep, Appleton, WI (US)

(73) Assignee: Appleton Papers Inc., Appleton, WI (US)

( * ) Notice: Subject to any disclaimer, the term of this patent is extended or adjusted under 35 U.S.C. 154(b) by 533 days.

(21) Appl. No.: 11/730,755

(22) Filed: Apr. 4, 2007

(65) Prior Publication Data

US 2008/0248948 A1 Oct. 9, 2008

(51) Int. Cl.
*B41M 5/00* (2006.01)

(52) U.S. Cl. ..... 436/169; 436/94; 422/99; 422/101; 503/201; 503/200; 430/9; 430/10

(58) Field of Classification Search ..... 436/169, 436/164, 94; 422/99, 101; 106/31.17, 31.18; 503/201, 200; 283/94, 95; 430/9, 10
See application file for complete search history.

(56) References Cited

U.S. PATENT DOCUMENTS 5,026,190 A * 6/1991 Longarzo ..... 401/30
5,208,630 A * 5/1993 Goodbrand et al. ..... 399/15
5,261,954 A * 11/1993 Collings ..... 106/31.17
5,304,587 A * 4/1994 Oswald et al. ..... 523/161
5,385,803 A * 1/1995 Duff et al. ..... 430/138
5,569,317 A * 10/1996 Sarada et al. ..... 524/111
5,939,468 A * 8/1999 Siddiqui ..... 523/161
2008/0003144 A1 * 1/2008 Cumberland et al. ..... 422/99

* cited by examiner

*Primary Examiner*—Walter D Griffin
*Assistant Examiner*—Christine T Mui
(74) *Attorney, Agent, or Firm*—Benjamin Mieliulis

(57) ABSTRACT

The present invention relates to a unique dual color security paper authentication system. The authenticating system comprises the combination of a security paper together with a coordinated applicator. The paper contains a starch, an iodide salt and an acidic developer resin. The applicator of the system comprises two authenticating solutions. The first authenticating solution comprises one or more of a sulfonamide and a copper salt dispersed in a solvent. The second authenticating solution comprises one or more of a leuco and fluoran dye precursor dispersed in a solvent. On applying the authenticating solutions to authentic security paper, a first color of a starch iodine is expressed and a second color of a leuco or fluoran dye is expressed.

14 Claims, 1 Drawing Sheet

SECURITY PAPER AUTHENTICATION SYSTEM WITH DUAL INSTANT COLOR

BACKGROUND OF THE INVENTION

1. Field of the Invention

This invention relates to methods and indicators of authenticity. The system of the invention is useful in the authentication of security papers. The invention is particularly useful with documents, tags and labels.

2. Description of Related Art

Indicators to ascertain the genuineness of documents, tags and labels have been proposed in several different forms.

U.S. Pat. No. 3,063,163 to Carmeli teaches a method of detecting counterfeit currency substrates by applying an iodine solution to the substrate to react with starch yielding a brown to black marking. Carmeli is a negative indicator in that genuine currency does not undergo a color change. Counterfeit currency on the other hand forms a bluish black mark with the iodine indicator, attributed to a difference in starch content. The marking is fairly permanent, however can be made to dissipate over a few days by inclusion of oxidizing agent.

Wood U.S. Pat. No. 4,037,007 teaches secure documents with color forming planchettes. A color forming reaction of azo compounds or lactone or leuco compounds with an organic acid is taught for forming a color change or change from colorless to colored form.

Collings, U.S. Pat. No. 5,188,887 teaches an authentication system comprising a paper carrying a starch and iodate salt to which an authenticating solution of an iodide salt is applied. Collings U.S. Pat. No. 5,261,954 teaches combinations of iodide salts together with a variety weak acids applied to starch and iodate bearing papers. These patents teach presence of iodine salts in both the paper substrate and applicator.

Use of iodide and iodate in security papers can be traced to patents such as Carvalio U.S. Pat. No. 531,507 which taught blending paper pulp with a combination of bismuth iodide and sodium iodide; and Menzies U.S. Pat. No. 302,758 taught paper coated or immersed into a solution of potassium iodide and iodate. Papers laced with such materials are described as useful for detection of forgery or attempted alteration.

Carmeli U.S. Pat. No. 5,063,163 is a more recent example of a method to detect authentic currency taking advantage of the starch content by applying an iodine solution to the currency paper.

More recently Ukpabi U.S. Pat. No. 7,163,909 taught a rapidly reversing indicator based on application of selected acidic solutions to a paper coated with phthalide, leucauramine or fluoran chromogens.

Although the various above described systems have utility for certain applications, a need exists for more selective authenticity indicators. Many of the above systems are commonly used giving rise in some applications to increased likelihood of false positives, such as when an iodine indicator is applied to a starch coated paper, even though not currency. Where applicators are used, it is also desirable to minimize use of stain-producing materials to reduce messiness in use, or to avoid use of ingredients perceived as environmentally less desirable or undesirable from a safe handling or neatness aspect.

These and other aspects such as the desire for systems unique to a manufacturer have given rise to a need and desire for improved authenticity indicators.

DETAILED DESCRIPTION OF THE INVENTION

Figure 1:
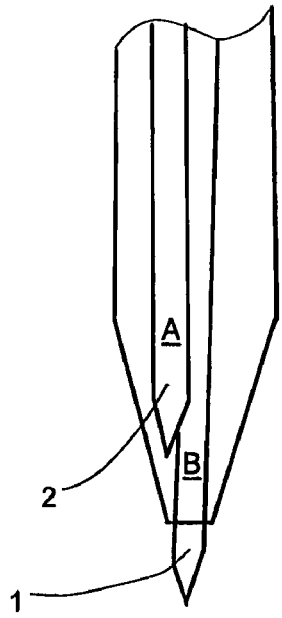
FIG. 1 is a schematic of an applicator device.

A security paper authenticating system is described. The authenticating system comprises a dual color authentication system. The authenticating system comprises the combination of a security paper together with a coordinated applicator.

Secure paper in the context of the invention comprises a substrate typically paper having means to aid in identification of the substrate as genuine. Examples of uses for security papers include negotiable instruments, letters of credit, checks, bonds, money orders, certified checks, titles, passports, certificates, diplomas, lottery tickets, vouchers, event tickets, coupons, tokens, identity documents, credit cards, gift cards, and the like. To the extent the substrate has a value, it becomes desirable to deter counterfeits or to provide means to readily identify authentic substrate.

The substrate is preferably paper but can include paper or synthetic paper films, paper blends with synthetics, polymeric materials, polymeric materials coated for ink receptivity, paper and polymeric laminates, card stock, label stock and the like.

The substrate is generally in sheet or card or label form, but could also be roll stock. The substrate, which can be paper or laminate of several similar or dissimilar materials, typically has two large surface dimensions and a comparatively small thickness dimension. The substrate can be opaque, translucent, or transparent. Preferably the substrate is opaque and fibrous such as paper stock or paper and filamentous synthetic material combinations or laminates. When polymeric materials are used, they are preferably treated with an ink receptor coating to facilitate printing and writing on the surface.

The security paper authenticating system comprises the combination of a security substrate and an applicator comprising at least two authenticating solutions. The security paper contains starch; a salt of iodine and an acidic color developer material The starch, salt of iodine and acidic color developer can be applied as a coating to the substrate by various coating means including spraying, brushing, air knife, rod coater, flexo coater, curtain coater, or by immersion or by other commonly known coating application techniques. One or more of the materials can also optionally be incorporated as part of the paper furnish such as in the wet end of a paper forming machine or applied at various stages of the paper formation process. The coating can be applied at the size press or even applied by printing. Preferably the salt of iodine is from 0.1 to 20% by weight of the coating, more preferably 0.2 to 10% by weight of the coating. The acidic developer material is preferably from 1 to 20% of the coating, preferably 1.5 to 10% of the coating. Starch is from 0. Ito about 30 weight percent, with 0.1 to about 10% preferred of the coating blend.

If incorporated as part of the furnish or paper stock, the starch shall be added to about 0.05 to 20% by weight of the paper furnish on a dry weight basis of the weight of the furnish, preferably from 1 to 15% by weight, and more preferably 1 to 10% by weight of the paper furnish on a dry weight basis.

Similarly the salt of iodine can be incorporated in the furnish from 0.05 to about 8% by weight of the furnish on a dry weight basis, preferably about 0.1 to 3% on a dry weight basis. The acidic developer can be incorporated at from 5 to about 25% by weight preferably about 10 to about 20% by weight on a dry weight basis. The acidic developer can be incorporated at from about 01.5 to about 15 weight percent on a dry weight basis, preferably 3 to about 8 weight percent, more preferably 1 to about 3 weight percent on a dry weight basis of the weight of the paper furnish.

The starches can include various organic derived or synthetic starches including corn starch, potato starch, tapioca starch, wheat starch, cationic or amphatoric, anionic, or modified starches such as hydroxylpropylated, acetylated, acid modified, or phosphate ester or dextrin modified starches.

The paper can be selected based on the intended end use application and would typically be from about 30 g/m$^2$ to about 100 g/m$^2$ or higher.

The applicator comprises a stylus with a dual element writing tip. Preferably the writing tip is felt or felt-like of the type used commonly for highlighters or marking pens. Optionally the writing tip is a ball writer or fibrous or porous material although a felt-like tip is preferred. The writing tip directly or indirectly communicates with a chamber holding the authenticating solution. The first writing tip communicates with a first chamber holding a first authenticating solution. The second element of the writing tip communicates with a second chamber holding a second authenticating solution.

The first authenticating solution comprises one or more of a sulfonamide and a copper salt dispersed in a solvent. Preferably the sulfonamide is an aryl sulfonamide, more preferably a chloro toluene sulfonamide such as n-chloro-para-toluene sulfonamide.

Other useful sulfonamides include sulfonamides represented by the following formula and salts thereof

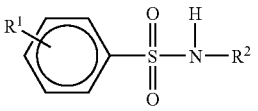

wherein $R^1$ is selected from $C_1$-$C_8$ alkyl, hydroxyl, and carboxy;

wherein $R^2$ is selected from halogen, $C_1$-$C_8$ alkyl, hydrogen, carboxy, carboxyaryl, and carboxyalkyl.

Leuco and fluoran dye precursors for purposes hereof include materials such as phthalide, leucauramine and fluoran compounds, including Crystal Violet Lactone (3,3-bis(4-dimethylaminophenyl)-6-dimethylaminophthalide, U.S. Pat. No. RE. 23,024); phenyl-, indol-, pyrrol- and carbazol-substituted phthalides (for example, in U.S. Pat. Nos. 3,491,111; 3,491,112; 3,491,116; 3,509,174); nitro-, amino-, amido-, sulfonamido-, aminobenzylidene-, halo-, anilino-substituted fluorans (for example, in U.S. Pat. Nos. 3,624,107; 3,627,787; 3,641,011; 3,642,828; 3,681,390); spiro-dipyrans (U.S. Pat. No. 3,971,808); and pyridine and pyrazine compounds (for example, in U.S. Pat. Nos. 3,775,424 and 3,853,869). Other eligible materials include: 3-diethylamino-6-methyl-7-anilino-fluoran (U.S. Pat. No. 3,681,390); 2-anilino-3-methyl-6-dibutylamino-fluoran (U.S. Pat. No. 4,510,513) also known as 3-dibutylamino-6-methyl-7-anilino-fluoran; 3-dibutylamino-7-(2-chloroanilino)fluoran; 3-(N-ethyl -Ntetrahydrofurfturylamino)-6-methyl-7-3-5'6-tris(di-methylamino) spiro[9H-fluorene-9'1 (3'H)isobenzofuran]-3'-one; 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino) fluoran (U.S. Pat. No. 3,920,510); 3-(N-methylcyclohexylamino)-6-methyl-7-anilino-fluoran (U.S. Pat. No. 3,959,571); 7-(1-octyl-2-methylindol-3-yl)-7-4-(4-diethylamino-2-ethoxy-phenyl)-5,7-di hydrofuro[3,4-b]pyridin-5-one; 3-diethylamino-7,8-benzofluoran; 3,3-bis(1-ethy-2-methylindol-3-yl) phthalide; 3-diethylamino-7-anilino-fluoran; 3-diethylamino-7-benzylaminofluoran; 3'-phenyl-7-dibenzylamino-2,2'-spiro-di-[2H -1-benzo-pyran]; 6[ethyl(3-methylbutyl)amino]-3'-methyl-2'(phenylamino)-spiro[isobenzofuran-1(3H), 9'-[9H]xanthen]-3-one; 6-(dimethylamino-3,3-bis(4-(dimethylamino)phenyl)-1(3H) -isobenzofuranone (crystal violet lactone); 3-diethylamino-6-methyl-7-(2,4-dimethylphenyl)aminofluoran and mixtures of any of the foregoing. The various alpha, beta or other crystalline forms, of some of the fluourans, where such are known, are equally functional, and equivalent for purposes of this invention.

Useful acidic resin color developer materials include phenolic resins such as novolak resins which are the product of reaction between, for example, formaldehyde and a phenol such as an alkylphenol, e.g., p-octylphenol, or other phenols such as p-phenylphenol, phenol-formaldehyde polymers such as disclosed in U.S. Pat. Nos. 3,455,721; 3,672,935; 3,244,550 and 4,573,063; metal-modified phenolic resins such as disclosed in U.S. Pat. Nos. 3,732,120; 3,737,410; 4,165,102; 4,165,103; 4,166,644 and 4,188,456 incorporated herein by reference; acetylated phenolic resins, salicylic acid modified resins. Aromatic carboxylic acids such as salicylic acid; derivatives of aromatic carboxylic acids; and metal salts thereof such as zinc salicylate (U.S. Pat. No. 4,022,936) can be optionally added.

The acidic color developer material can be selected to be an inorganic color developer. Such color developers are inorganic acid minerals such as montmorillonite, for example as disclosed in British Patent No. 1213835; colloidal silica, kaolin, bentonite, attapulgite, silton clay, hallosyte, and the like. Alternatively, or in addition, inorganic acid minerals can include acid clays or semi-synthetic inorganic developers as disclosed for example, in European Patent Application Nos. 44645 and 144472A, or alumina/silica color developers such as disclosed in European Patent Application Nos. 42265A, 42266A, 434306A, or 518471A. Preferred in the invention are phenolic resins such as novolak resins or acidic clays, and the various metal modified and salicylic acid modified phenolic resins.

Other useful eligible acidic developer materials include the compounds listed in U.S. Pat. No. 3,539,375 as phenolic reactive material, particularly the monophenols and diphenols. Eligible acidic developer material also includes, without being considered as limiting, the following compounds which may be used individually or in mixtures: 4,4'-isopropylidinediphenol (Bisphenol A); p-hydroxybenzaldehyde; p-hydroxybenzophenone; p -hydroxypropiophenone; 2,4-dihydroxybenzophenone; 1,1-bis(4-hydroxyphenyl) cyclohexane; salicylanilide; 4-hydroxy-2-methylacetophenone; 2-acetylbenzoic acid; m -hydroxyacetanilide; p-hydroxyacetanilide; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl (4-hydroxyphenyl)ketone; 2,2-bis(4-hydroxyphenyl)-5-methylhexane; ethyl-4,4-bis(4-hydroxyphenyl)pentanoate; isopropyl-4,4-bis(4-hydroxyphenyl)pentanoate; methyl-4,4-bis(4-hydroxyphenyl)pentanoate; alkyl-4,4-bis(4-hydroxyphenyl)

pentanoate; 3,3-bis(4-hydroxyphenyl)pentane; 4,4-bis(4-hydroxyphenyl)heptane; 2,2-bis(4-hydroxyphenyl)-1-phenylpropane; 2,2-bis(4-hydroxyphenyl) butane; 2,2'-methylene-bis(4-ethyl-6-tertiarybutyl phenol); 4-hydroxycoumarin; 7-hydroxy-4-methylcoumarin; 2,2'-methylene-bis(4-octyl phenol); 4,4'-sulfonyldiphenol; 4,4'-thiobis(6-tertiarybutyl-m-cresol); methyl-p -hydroxybenzoate; n-propyl-p-hydroxybenzoate; benzyl-p-hydroxybenzoate.

In FIG. 1 on applicator is depicted of the type having two separate ink compartments A and B. Ink tip 1 is shown as a retractable ink holder type. Ink tip 2 can be fashioned to be rotatably extended and retracted in place of ink tip 1. The ink tips can be conventionally described as ink refills such as for a ballpoint pen. Preferably, for purposes of the invention the ink tips are felt tip refills, or marker type such as highlighter tips.

Figure 2:
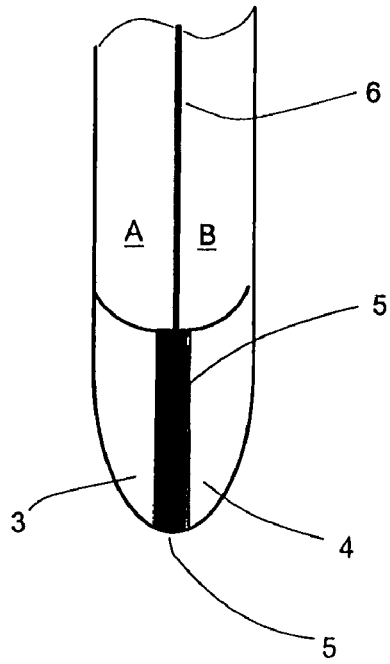
FIG. 2 is a schematic section view of an alternative applicator embodiment according to the invention.

FIG. 2 is a preferred embodiment depicting tip 3 communicating with ink chamber or compartment A and tip 4 communicating with a second ink chamber B or compartment. Compartments A and B are separated by partition 6. Preferably the tips 3 and 4 are a felt or felt-like porous material suitable for ink application, and are separated by a thin barrier material such as Teflon separator 5 (shown with exaggerated width for purposes of illustration).

In FIG. 2 the applicator tip can be stationary with both tips 3 and 4 writing concurrently yielding a dual color capability.

The system of the invention enables expression of two colors with application of the solutions of the applicator to the substrate.

A first color is expressed by the reaction of the sulfonamide or copper salt of the first authenticating solution contacting the coated substrate expressing a reaction color in reaction with the iodine salt. Preferably the iodine salt is potassium iodide and excludes iodate. Other variations of the iodide salt can include Group 1A alkali metal and Group IIA alkaline metal iodides. The alkali metal iodides can include by way of illustration sodium iodide, potassium iodide, calcium iodide, bismuth iodide and the like. The iodine salt for purposes of the invention preferably is substantially free of iodate. Although not deleterious, iodate is not functional in the system described.

The copper salt is selected from preferably water soluble or dispersible salts such as sulphate, chloride, nitrate, phosphate, or chloride. In organic salts were preferred. Other copper salts can include various organic salts such as copper citrate, copper succinate, copper acetate, copper butyrate, copper salicylate, copper glutamate where copper has a valence state of +2. With some of the salts, alcoholic solvents may need to be employed such as acidified alcoholic solvents. The salts soluble in aqueous solution were preferred.

A second color arises from the separate and preferably concurrent reactions of the second authenticating solution contacting the coated substrate expressing a reaction color of the leuco or fluoran dye precursor with the developer on the substrate.

The following examples are given to illustrate some of the features of the present invention and should not be considered as limiting. Unless otherwise indicated, all measurements, parts and proportions herein are in the metric system and on the basis of weight.

EXAMPLE 1

| | Parts |
|---|---|
| Potassium iodide | 0.2 to 10 parts |
| Phenolic novolak resin (Durez, Novi Michigan) | 1.5 to 10 |
| Cornstarch | 0.1 to 10 |
| Water | 70 to 98.2 |

The above coating slurry is applied to a paper substrate using a rod coater at about 5 grams per square meter. Alternatively the coating materials could be dispersed into the paper furnish on the wet end of the paper machine such as a Fourdrinier.

| | Parts |
|---|---|
| Authenticating solution 1<br>n-chloro-p-toluene sulfonamide (sodium salt) is dispersed in water to form a 2 to 8% solution | |
| n-chloro-p-toluene sulfoamide | 2 to 8 |
| water | 92 to 98 |
| Authenticating solution 2 | |
| Leuco dye | 4 |
| Vegetable oil (Lambert Technologies, Gurnee, IL) | 96 |

The authenticating solutions are applied to the coating substrate. Authenticating solution 1 expresses a first reaction color of sulfonamide with iodine and starch and authenticating solution 2 concurrently expresses a second color.

EXAMPLE 2

| | Parts |
|---|---|
| Potassium iodide | 1 |
| Phenolic novolak resin (Durez, Novi Michigan) | 3 |
| Cornstarch | 1 |
| Water | 95 |

| | Parts |
|---|---|
| Authenticating solution 1<br>n-chloro-p-toluene sulfonamide (sodium salt) is dispersed in water to form 5% solution | |
| n-chloro-p-toluene sulfoamide | 5 |
| water | 95 |
| Authenticating solution 2 | |
| I6B 3,3-bis (1-octyl-1methylidolyl-3yl)phthalide | 1 |
| n-butyl biphenyl solvent | 99 |

When applied to the coated paper, a dark blue color of authenticating solution 1 was expressed, along with a magenta color formed from contact of authenticating solution 2 with the substrate.

EXAMPLE 3

| | Parts |
|---|---|
| Potassium iodide | 0.8 |
| Phenolic novolak resin (Durez, Novi Michigan) | 4.4 |
| Cornstarch | 0.8 |
| Water | 94 |

The above coating slurry is applied to a paper substrate using a rod coater at about 5 grams per square meter. Alternatively the coating materials could be dispersed into the paper furnish on the wet end of the paper machine such as a Fourdinier.

| | Parts |
|---|---|
| Authenticating solution 1<br>n-chloro-p-toluene sulfonamide (sodium salt) is dispersed in water to form 6% solution | |
| n-chloro-p-toluene sulfonamide | 6 |
| water | 94 |
| Authenticating solution 2 | |
| Crystal Violet Lactone | 1.2 |
| n-butyl biphenyl solvent (SAS 310 Nisseki, Pasadena, TX) | 98.8 |

when applied to the coated paper, a dark blue color of authenticating solution 1 was expressed, along with a differing shade of blue of authenticating solution 2.

The references identified in the specification are incorporated in the specification by reference to the extent that they supplement, explain, provide background for or teach methodology, techniques, materials, or compositions employed herein.

The principles, preferred embodiments, and modes of operation of the present invention have been described in the foregoing specification. The invention which is intended to be protected herein, however, is not to be construed as limited to the particular form disclosed, since those are to be regarded as illustrative rather than restrictive. Variations and changes can be made by those skilled in the art without departing from the spirit and scope of the invention.

What is claimed is:

1. A security paper authenticating system comprising the combination of a security paper and an applicator with at least two authenticating solutions, the security paper containing a starch, a salt of iodine, and an acidic developer material, the applicator comprising a stylus with at least a dual element writing tip, wherein the first element of the writing tip communicates with a first chamber holding a first authenticating solution, and the second element of the writing tip communicates with a second chamber holding a second authenticating solution;

the first authenticating solution comprising one or more of a sulfonamide and a copper salt dispersed in a solvent;

the second authenticating solution comprising one or more of a leuco and fluoran dye precursor dispersed in a solvent;

whereby on applying the dual authenticating solutions to authentic security paper, iodine is generated in situ from the reaction of the first authenticating solution and salt of iodine, and a first color of a starch iodine color is expressed;

and whereby the second authenticating solution concurrently expresses a second color of a leuco or fluoran dye.

2. The system according to claim 1 wherein the salt of iodine is an alkali metal iodide.

3. The system according to claim 1 wherein the sulfonamide is of the formula

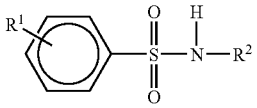

wherein $R^1$ is selected from $C_1$-$C_8$ alkyl, hydroxyl, and carboxy;

wherein $R^2$ is selected from $C_1$-$C_8$ alkyl, halogen, hydrogen, carboxy, carboxyaryl, and carboxyalkyl; and salts thereof.

4. The system according to claim 1 wherein the sulfonamide is an aryl sulfonamide.

5. The system according to claim 3 wherein the sulfonamide is n-chloro-p-toluene sulfonamide.

6. The system according to claim 1 wherein the copper salt is copper sulfate.

7. The system according to claim 1 wherein the paper contains a starch, iodide and an acidic developer material.

8. The system according to claim 7 wherein the acidic developer material is a phenolic resin.

9. The system according to claim 7 wherein the acidic developer material is selected from the group consisting of acetylated phenolic resin, salicylic acid modified phenoic resin, and novolac phenolic resin.

10. The system according to claim 1 wherein the acidic developer material is an inorganic acid mineral.

11. A security paper authenticating system comprising the combination of a security paper and an applicator with two authenticating solutions, the security paper containing a starch, a salt of iodine, and an acidic developer material, the applicator comprising a stylus with a dual element writing tip, wherein the first element of the writing tip communicates with a first chamber holding a first authenticating solution, and the second element of the writing tip communicates with a second chamber holding a second authenticating solution;

the first authenticating solution comprising one or more of an aryl sulfonamide and copper sulphate dispersed in a solvent;

the second authenticating solution comprising one or more of a leuco and fluoran dye precursor dispersed in a solvent;

whereby on applying the dual authenticating solutions to authentic security paper, iodine is generated in situ from the reaction of the first authenticating solution and salt of iodine, and a first color of a starch iodine color is expressed;

and whereby the second authenticating solution expresses a second color of a leuco or fluoran dye.

12. The system according to claim 11 wherein the dual element writing tip is a combination of two writing tips each of which is separately retractable.

13. An authentication method comprising:

providing a substrate containing a starch, a salt of iodine, and an acidic developer material;

providing an applicator comprising two authenticating solutions maintained in separate chambers, wherein the first authenticating solution is selected from one or more of a sulfonamide and a copper salt, wherein the second authenticating solution comprises one or more of a leuco and fluoran dye precursor dispersed in a solvent;

applying the first authenticating solution to the substrate to express a first color of a starch iodine color;

and applying the second authenticating solution to the substrate to express a second color of a leuco or fluoran dye.

14. The method according to claim 13 wherein the first authenticating solution and the second authenticating solution are applied to the substrate concurrently.

* * * * *